US010000086B2

(12) United States Patent
Peleman

(10) Patent No.: US 10,000,086 B2
(45) Date of Patent: Jun. 19, 2018

(54) BINDING DEVICE

(71) Applicant: UNIBIND LIMITED, Nicosia (CY)

(72) Inventor: Guido Peleman, Knokke-Heist (BE)

(73) Assignee: UNIBIND LIMITED, Nicosia (CY)

( * ) Notice: Subject to any disclaimer, the term of this patent is extended or adjusted under 35 U.S.C. 154(b) by 0 days. days.

(21) Appl. No.: 15/527,992

(22) PCT Filed: Jan. 25, 2016

(86) PCT No.: PCT/IB2016/000042
§ 371 (c)(1),
(2) Date: May 18, 2017

(87) PCT Pub. No.: WO2016/128814
PCT Pub. Date: Aug. 18, 2016

(65) Prior Publication Data

US 2017/0326896 A1 Nov. 16, 2017

(30) Foreign Application Priority Data

Feb. 10, 2015 (BE) ..... 2015/5071

(51) Int. Cl.
*B42C 99/00* (2006.01)
*B42C 11/04* (2006.01)
*B42C 9/00* (2006.01)

(52) U.S. Cl.
CPC ..... *B42C 11/04* (2013.01); *B42C 9/0056* (2013.01)

(58) Field of Classification Search
CPC ... B42C 11/04; B42C 11/1902; B42C 9/0018; B42C 9/0006; B42C 19/00
See application file for complete search history.

(56) References Cited

U.S. PATENT DOCUMENTS 3,730,806 A * 5/1973 Heller ..... B42C 9/00 156/272.4
3,925,126 A * 12/1975 Leatherman ..... B42C 11/04 156/272.4

(Continued)

FOREIGN PATENT DOCUMENTS

| | | | |
|---|---|---|---|
| BE | 1010681 | A3 | 11/1998 |
| EP | 0 508 945 | A1 | 10/1992 |
| EP | 0 841 192 | A1 | 5/1998 |

OTHER PUBLICATIONS

International Search Report, dated Apr. 22, 2016, from corresponding PCT application.

*Primary Examiner* — Shin H Kim
(74) *Attorney, Agent, or Firm* — Young & Thompson

(57) ABSTRACT

Disclosed is a binding device for binding a bundle of leaves in a binding element of a magnetic material, whereby this binding device is provided with a support for the binding element that is formed by a U-shaped profile with a base and two legs, whereby this binding device is provided with a heating element that is between the legs of the profile and makes contact with the base. The binding device is provided with a switch for switching the heating element with a magnet that is between the legs of the profile and can move towards the base of the profile, whereby the profile is provided with wings oriented towards the center of the profile that keep the magnet at a distance from the base and/or the heating element when the magnet moves towards the base of the profile.

20 Claims, 2 Drawing Sheets

(56) References Cited

U.S. PATENT DOCUMENTS

Figure 1:
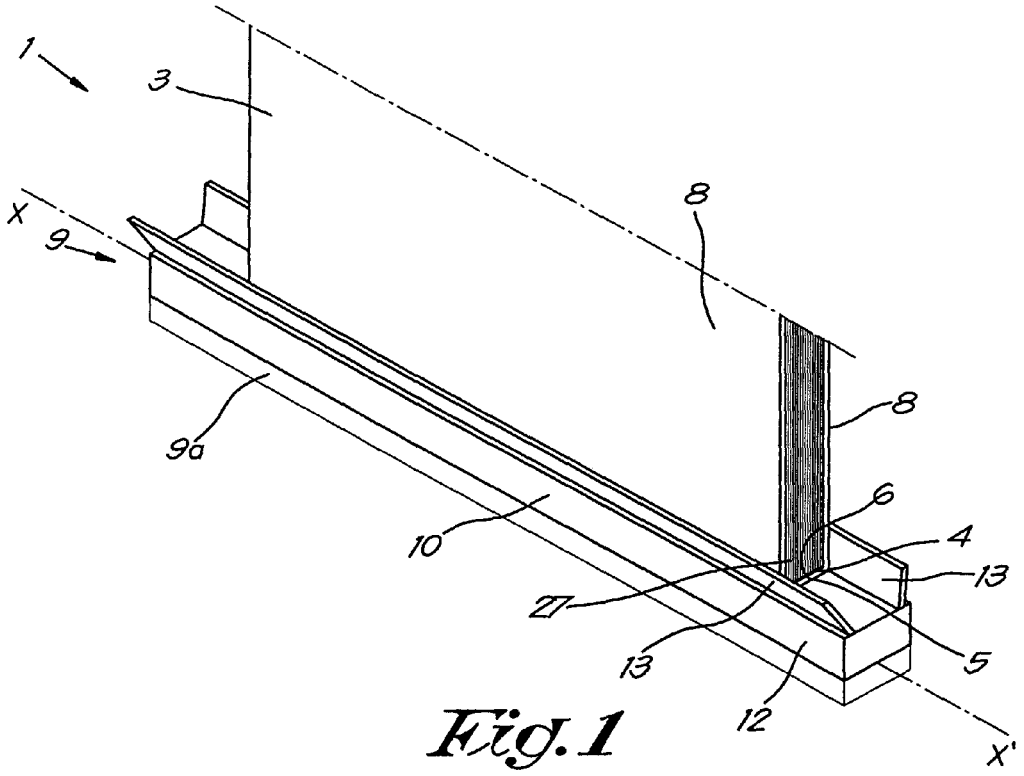

| | | | | |
|---|---|---|---|---|
| 4,678,386 | A | 7/1987 | Wiholm | |
| 2002/0007901 | A1* | 1/2002 | Parker | B42C 7/005 156/196 |
| 2007/0085256 | A1* | 4/2007 | Miyake | B42C 9/0018 270/52.18 |
| 2017/0305181 | A1* | 10/2017 | Mueller | B42C 7/005 |
| 2017/0305182 | A1* | 10/2017 | Mueller | B42C 7/004 |

* cited by examiner

BINDING DEVICE

The present invention relates to a binding device.

More specifically, the invention concerns a binding device for binding a bundle of leaves in a binding element with a spine, whereby a layer of hotmelt adhesive is provided on at least the bottom of the spine, whereby this binding device is provided with a support on which the spine of the binding element can be placed, whereby this support is formed by a U-shaped profile with a base and two legs, whereby the open side of the U-shape is oriented downwards, whereby the binding device is further provided with at least one heating element to be able to heat up the support, whereby this heating element is located between the legs of the U-shaped profile and makes contact with the base.

When the binding element is placed on the support, the hotmelt adhesive will melt under the effect of the heat. As a result the bundle of leaves will be able to penetrate into the hotmelt adhesive and after solidification of the hotmelt adhesive will be bound in the binding element.

The heating elements only have to be switched on during use, and to this end the binding device can be equipped with a switch that the user can operate.

A disadvantage of this is that the user may forget to switch off the switch after use. This means that the heating elements will remain hot, which can possibly lead to hazardous situations. This will also be coupled with needless energy consumption.

A system with a magnetic switch that detects the presence of a binding element is already known from BE 1.010.681, but it turns out that such a system yields problems because the switch stops working properly.

Extensive research has shown that this is due to the fact that the magnetic capacity of the switch is lost in the event of prolonged heating.

In order to be able to provide a solution to at least one of the aforementioned and other disadvantages, to this end the invention covers a binding device for binding a bundle of leaves in a binding element with a spine, whereby the binding device is equipped such that the heating elements can switch on and off automatically.

The object of the present invention is a binding device for binding a bundle of leaves in a binding element with a spine of a magnetic or magnetisable material, whereby a layer of hotmelt adhesive is provided on at least the bottom of the spine, whereby this binding device is provided with a support on which the spine of the binding element can be placed, whereby this support is formed by a U-shaped profile with a base and two legs, whereby the open side of the U-shape is oriented downwards, whereby the binding device is further provided with at least one heating element to be able to heat the support, whereby at least one heating element is between the legs of the U-shaped profile and makes contact with the base, whereby the binding device is provided with a magnetic switch for switching the at least one heating element on and off with a movable magnet that is between the legs of the U-shaped profile and can move towards the base of the U-shaped profile when the binding element is placed on the support, whereby at least at the location of the aforementioned magnet the U-shaped profile is provided with wings oriented towards the centre of the U-shape that keep the magnet at a distance from the base and/or the heating element when the magnet moves towards the base of the U-shaped profile.

The magnetic or magnetisable material of the spine can be steel or similar for example.

An advantage is that the heating elements will automatically switch on by means of the magnetic switch when the binding element is placed on the support.

The magnet will be attracted by the spine and move upwards towards the base.

This movement will be detected by the magnetic switch that will then switch on the heating elements.

The moment that the spine is removed, the magnet will drop back down such that the switch will switch off the heating elements.

In this way the heating elements unintentionally remaining on for longer than necessary can be prevented.

The wings can prevent the magnet being able to make contact with the base of the support and/or the heating element.

This is to prevent the magnet also being heated by the heated base or the heating element, such that the magnet would lose its magnetic properties and the magnetic switch would no longer work.

The wings act as a stop as it were for the magnet in order to limit its course of travel. Indeed, without the wings the magnet would be attracted by the spine up to against the base of the support or against the heating element.

In the most preferred embodiment the aforementioned wings extend from the legs of the support.

This means that the wings are attached to the location of the legs of the support, and not at the location of the base for example.

This has the advantage that the wings are better protected against too high temperatures. Indeed, the heating elements heat the base of the support so that the legs of the support will be cooler than the base. By locating the wings on the cooler legs instead of on the hot base, the wings will also heat up less.

In this way the magnet, that can come into contact with the free ends of the wings, will be less hot.

Figure 2:
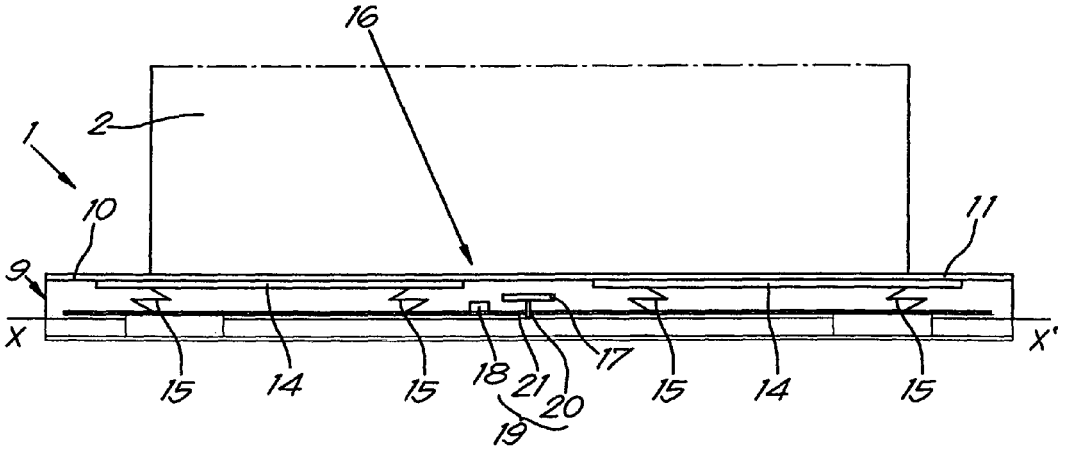
Figure 3:
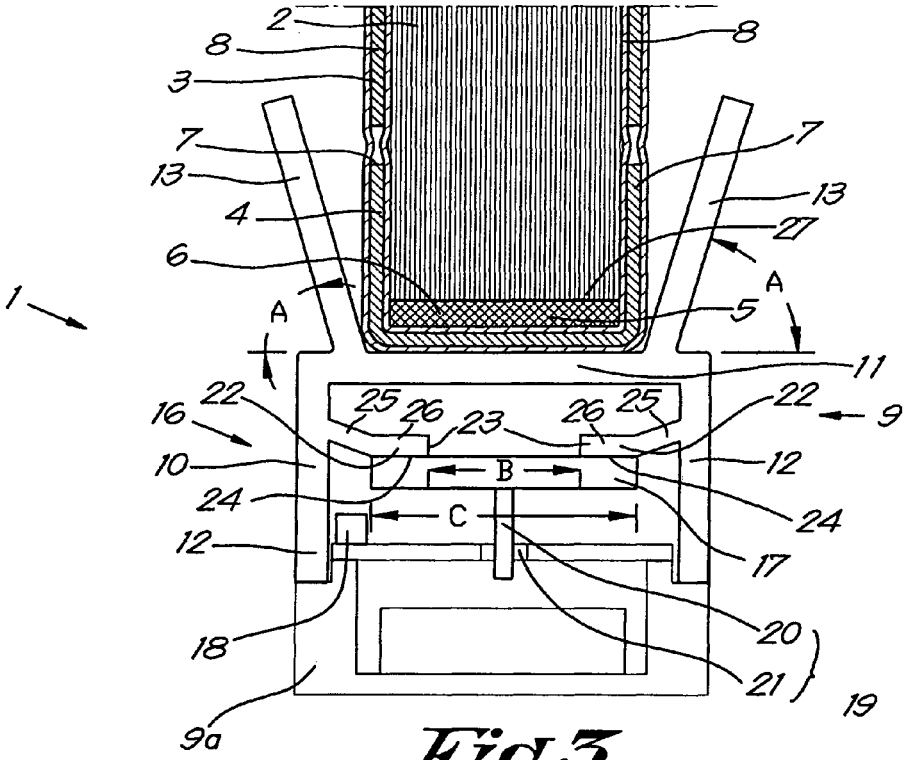
Figure 4:
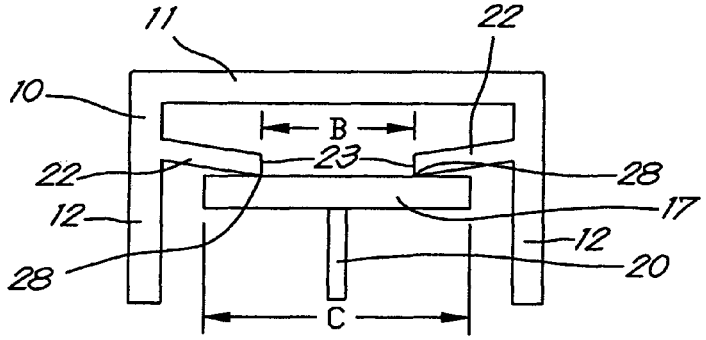
Figure 5:
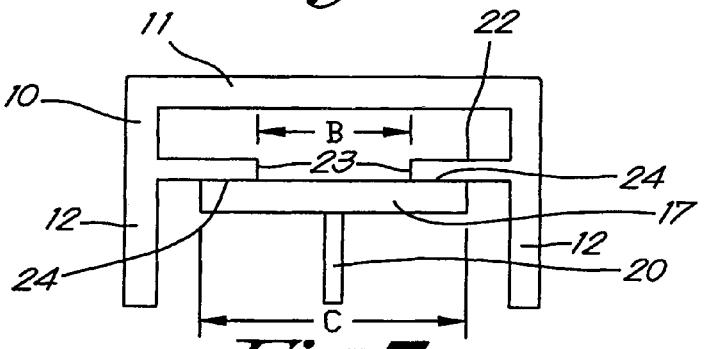

With the intention of better showing the characteristics of the invention, a few preferred embodiments of a binding device according to the invention are described hereinafter by way of an example, without any limiting nature, with reference to the accompanying drawings, wherein:

FIG. 1 schematically shows a perspective view of a binding device according to the invention;

FIG. 2 schematically shows a cross-section according to line of FIG. 1;

FIG. 3 schematically shows a cross-section according to line of FIG. 1;

FIGS. 4 and 5 show variants of the support of FIG. 3.

The binding device 1 shown in FIGS. 1 to 3 is used for binding a bundle of leaves 2 in a binding element 3.

As shown in the drawings the binding element 3 comprises a spine 4 that is made of a magnetic or magnetisable material, whereby a layer of hotmelt adhesive 6 is applied to the bottom 5. In the example shown, the free ends 7 of the spine 4 are provided with cover sheets 8. A bundle of loose leaves 2 is introduced in the spine 4 of the binding element 3.

The binding element 3 is placed on a support 9 of the binding device 1, whereby in this case this support 9 forms, as it were, part of the housing **9*a* of the binding device 1**.

This support 9 is formed by a U-shaped profile 10 with a base 11 and two legs 12, whereby the open side of the U-shaped profile 10 is oriented downwards.

As can be seen in FIGS. 1 and 3, the binding element 3 with the spine 4 is placed on the base 11 of the support 9.

In this case, but not necessarily, the base 11 of the support 9 is provided with two upright arms 13 that are on the side oriented away from the open side of the U-shaped profile 10.

These arms 13 are attached to the base 11 obliquely, i.e. at an angle A to the base 11 such that the arms 13 are somewhat oriented away from one another.

In this way the aforementioned arms 13 as it were form a type of guide when the spine 4 of the binding element 3 is placed on the base 11.

Moreover, the arms 13 can prevent the binding element 3 from unintentionally sliding from the base 11.

Although it is clear that the arms 13 are useful as they provide a few benefits, these arms 13 are not necessary for the good operation of a binding device 1 according to the invention. A binding device 1 without such arms 13 thus belongs to the scope of this invention.

The binding device 1 is further provided with at least one heating element 14. In this case there are two heating elements 14, as can be seen in FIG. 2, that are located between the legs 12 of the support 9.

The heating elements 12 make contact with the base 11. In this example, but not necessarily, they are pushed against the base 11 by means of springs 15 so that a good contact is possible. The heating elements 12 will be able to heat up the support 9.

The binding device 1 is further provided with a magnetic switch 16 for switching the heating elements 14 on and off with a magnet 17 and a sensor 18.

This magnet 17 is between the legs 12 of the support 9 and can move towards the base 11 of the U-shaped profile 10, and this under the influence of the force of attraction of the spine 4 of the binding element 3 that is placed on the base 11 and which is made of magnetic or magnetisable material.

The sensor 18 will be able to detect the movements of the magnet 17 and on the basis of this detection the magnetic switch 16 will switch the heating elements 14 on and off.

In this case, but not necessarily, the binding device 1 is provided with a guide 19 for this movement of the magnet 17.

In this case this guide 19 consists of a small rod 20 that is fastened to the magnet 17 and which is slideable in an opening 21 provided to this end in the binding device 1. In this way the rod 20 will ensure that during its movements towards the base 11 and away from the base 11, i.e. up-and-down movements, the magnet 17 is kept in the right location.

It is clear that this guide 19 can be constructed in many different ways and that the example shown with the rod 20 slideably affixed in the opening 21 is only one of the many possibilities that a person skilled in the art could conceive to realise a guide 19.

In order to prevent the magnet 17 being able to move up against the base 11 during its upward movement under the influence of the force of attraction of the magnetic or magnetisable spine 4 that is placed on the base 11, the U-shaped profile 10 of the support 9 is provided with wings 22 oriented towards the centre of the U-shape.

These wings 22 will act as a stop as it were to keep the magnet 17 at a distance from the base 11 when the magnet 17 moves towards the base 11 of the U-shaped profile 10.

In order to be able to hold back the magnet 17, the distance B between the free ends 23 of the wings 22 is smaller than the corresponding transverse dimensions C of the magnet 17, i.e. the width C of the magnet 17 measured in a direction transverse to the longitudinal direction X-X' of the U-shaped profile 10.

It is preferable that the aforementioned width C of the magnet is at least 1 millimeter greater than the distance B between the wings 22, preferably at least 2 millimeters, preferably even 3 millimeters and even better 4 millimeters.

In this case, the wings 22 extend over a certain distance from the free end 12 parallel to the base 11 of the support 9.

This has the advantage that there is a contact surface 24 between the magnet 17 and this section of the wings 22, against which the magnet 17 will be pushed under the influence of the force of attraction of the spine 4.

As a result a stable position of the magnet 17 is obtained, whereby it cannot tilt or move and thus unintentionally get between the wings 22.

In this case the wings 22 are composed of two parts, i.e. a first part 25 that extends from the support 9 and is oriented away from the base 11 of the support 9 and a second part 26 following therefrom that extends parallel to the base 11 of the support 9.

It is with this second part 26 that the wings 22 extend over a certain distance from the free end 23 parallel to the base 11 of the support 9.

The wings 22 extend from the legs 12 of the support 9, i.e. the wings 22 are attached to the legs 12. This is because the legs 12 of the support 9 will be cooler than the base 11 when the support 9 is heated up, so that in this way the wings 22 will become less hot.

In this case, but not necessarily, the wings 22 protrude over the entire length of the support 9. This has the advantage that the U-shaped profile 10 that forms the support 9 can be produced by means of extrusion.

It is also possible that the wings 22 are only located at the position of the magnet 17.

The operation of the binding device 1 is very simple and as follows.

A bundle of leaves 2 to be bound is inserted into the binding element 3, whereby the edge 27 of the bundle of leaves 2 to be bound is introduced in the spine 4, with this edge 27 against the layer of hotmelt adhesive 6.

The spine 4 of the binding element 3 is placed on the base 11 of the support 9 by a user.

Due to the upright arms 13 the spine 4 will be guided to the right location as it were.

Due to the force of attraction between the magnet 17 of the magnetic switch 16 and the magnetic or magnetisable spine 4, the magnet 17 will move upwards towards the base 11.

The wings 22 will keep the magnet 17 at a distance from the base 11.

The upward movement of the magnet 17 and the changing magnetic field coupled therewith will be detected by the sensor 18.

On the basis of the signal from the sensor 18, the magnetic switch 16 will switch on the heating elements 14, such that the base 11 will heat up.

The heat of the base 11 will make the hotmelt adhesive 6 in the spine 4 melt. As a result the leaves 2 can penetrate into the liquefied adhesive.

Because the magnet 17 is held back by the wings 22, the magnet 17 will barely heat up if at all. As a result there is no risk that the magnet 17 will lose its magnetic properties.

Indeed, because the wings 22 extend from the legs 12 of the support 9, they will only heat up very slightly. Indeed, the heat from the heating elements 14 must travel an entire path, flowing via the base 11 and the legs 12 to come to the wings 22.

If the wings 22 extended from the base 11, the heat from the heating elements 14 would have to cover a much shorter path to get to the wings 22, so that these wings 22 would heat up, and consequently also the magnet 17.

When the hotmelt adhesive 6 has fully melted, the user will remove the binding element 3 from the support 9. The hotmelt adhesive 6 will then cool down and thus solidify, such that the bundle of leaves 2 is bound in the binding element 3.

Because the spine 4 is removed from the support 9, the magnet 17 will no longer experience a force of attraction.

As a result the magnet 17 will drop back to its original position.

This is again coupled with changing magnetic fields that are detected by the sensor 18.

On the basis of the signal from the sensor 18 the magnetic switch 16 will switch off the heating elements 14.

During the downward movement of the magnet 17 the guide 19, which in this case consists of the rod 20 that is held in the opening 21, will guide the magnet 17 to its original position.

During the downward movement the rod 20 will drop further back in the opening 21, such that the magnet 17 will automatically come back to its original position.

FIG. 4 shows an alternative for the cross-section of the support 9 of FIG. 3.

In this case the wings 22 only have the aforementioned first section 25, but they do not have a second section 26 that extends parallel to the base 11 of the support 9.

In this case there will only be a contact edge 28 between the wings 22 and the magnet 17, but no contact surface 24, when the magnet 17 is moved upwards under the influence of the force of attraction of the spine 4.

Although such wings 22 will also prevent the magnet 17 being able to come up against the base 11 when the distance B between the free ends 23 of the wings 22 is chosen to be sufficiently small, with this embodiment the magnet 17 will be somewhat less stable and there is a small risk that the magnet 17 will tilt and could thereby unintentionally come up against the base 11.

FIG. 5 shows another alternative embodiment.

Hereby the wings 22 extend completely parallel to the base 11 of the support 9.

In all examples shown above it is possible that the wings 22 are made of an insulating material or at least that the section of the wings 22, that can come into contact with the magnet 17, is provided with a casing or similar of an insulating material.

This has the advantage that in this way the magnet 17 will not be exposed to any temperature increases of the wings 22.

Although in the examples shown the magnet 17 is between the two heating elements 14, it is not excluded that the magnet 17 is located under a heating element. In this case the wings 22 are such that they will prevent the magnet 17 from being able to come up against the heating element 14.

The present invention is by no means limited to the embodiments described as an example and shown in the drawings, but a binding device according to the invention can be realised in all kinds of forms and dimensions, without departing from the scope of the invention.

The invention claimed is:

1. Binding device for binding a bundle of leaves (2) in a binding element (3) with a spine (4) of a magnetic or magnetisable material, whereby a layer of hotmelt adhesive (6) is provided on at least the bottom (5) of the spine (4), whereby this binding device (1) is provided with a support (9) on which the spine (4) of the binding element (3) can be placed, whereby this support (9) is formed by a U-shaped profile (10) with a base (11) and two legs (12), whereby the open side of the U-shaped profile (10) is oriented downwards, whereby the binding device (1) is further provided with at least one heating element (14) to be able to heat the support (9), whereby at least one heating element (14) is between the legs (12) of the U-shaped profile (10) and makes contact with the base (11), wherein the binding device (1) is provided with a magnetic switch (16) for switching the at least one heating element (14) on and off with a movable magnet (17) that is between the legs (12) of the U-shaped profile (10) and can move towards the base (11) of the U-shaped profile (10) when the binding element (3) is placed on the support (9), whereby at least at the location of the aforementioned magnet (17) the U-shaped profile (10) is provided with wings (22) oriented towards the centre of the U-profile (10) that keep the magnet (17) at a distance from the base (11) and/or the heating element (14) when the magnet (17) moves towards the base (11) of the U-shaped profile (10).

2. Binding device according to claim 1, wherein the wings (22) extend from the legs (12) of the support (9).

3. Binding device according to claim 1, wherein the wings (22) extend over at least a limited distance from the free end (23) parallel to the base (11) of the support (9).

4. Binding device according to claim 1, wherein the wings (22) consist of two parts, i.e. a first part (25) that extends from the support (9) and is oriented away from the base (11) of the support (9) and a second part following therefrom (26) that extends parallel to the base (11) of the support (9).

5. Binding device according to claim 1, wherein the wings (22) extend over the entire length of the support (9).

6. Binding device according to claim 1, wherein the base (11) of the support (9) is provided with two upright arms (19) on the side oriented away from the open side of the U-shaped profile (10).

7. Binding device according to claim 1, wherein the wings (22) are made of an insulating material or that at least the section of the wings (22) that can come into contact with the magnet (17) is provided with a casing of an insulating material.

8. Binding device according to claim 1, wherein the binding device (1) is provided with a guide (19) for the movement of the magnet (17).

9. Binding device according to claim 2, wherein the wings (22) extend over at least a limited distance from the free end (23) parallel to the base (11) of the support (9).

10. Binding device according to claim 2, wherein the wings (22) consist of two parts, i.e. a first part (25) that extends from the support (9) and is oriented away from the base (11) of the support (9) and a second part following therefrom (26) that extends parallel to the base (11) of the support (9).

11. Binding device according to claim 3, wherein the wings (22) consist of two parts, i.e. a first part (25) that extends from the support (9) and is oriented away from the base (11) of the support (9) and a second part following therefrom (26) that extends parallel to the base (11) of the support (9).

12. Binding device according to claim 2, wherein the wings (22) extend over the entire length of the support (9).

13. Binding device according to claim 3, wherein the wings (22) extend over the entire length of the support (9).

14. Binding device according to claim 4, wherein the wings (22) extend over the entire length of the support (9).

15. Binding device according to claim 2, wherein the base (11) of the support (9) is provided with two upright arms (19) on the side oriented away from the open side of the U-shaped profile (10).

16. Binding device according to claim 3, wherein the base (11) of the support (9) is provided with two upright arms (19) on the side oriented away from the open side of the U-shaped profile (10).

17. Binding device according to claim 4, wherein the base (11) of the support (9) is provided with two upright arms (19) on the side oriented away from the open side of the U-shaped profile (10).

18. Binding device according to claim 5, wherein the base (11) of the support (9) is provided with two upright arms (19) on the side oriented away from the open side of the U-shaped profile (10).

19. Binding device according to claim 2, wherein the wings (22) are made of an insulating material or that at least the section of the wings (22) that can come into contact with the magnet (17) is provided with a casing of an insulating material.

20. Binding device according to claim 3, wherein the wings (22) are made of an insulating material or that at least the section of the wings (22) that can come into contact with the magnet (17) is provided with a casing of an insulating material.

* * * * *